US008701791B2

(12) United States Patent
Page

(10) Patent No.: US 8,701,791 B2
(45) Date of Patent: Apr. 22, 2014

(54) POST EXTRACTOR

(76) Inventor: Justin Page, Lloydminster Alberta (CA)

( * ) Notice: Subject to any disclaimer, the term of this patent is extended or adjusted under 35 U.S.C. 154(b) by 405 days.

(21) Appl. No.: 12/967,659

(22) Filed: Dec. 14, 2010

(65) Prior Publication Data

US 2012/0145425 A1 Jun. 14, 2012

(51) Int. Cl.
*E21B 19/00* (2006.01)

(52) U.S. Cl.
USPC ..... 173/90; 173/1; 173/29; 254/30; 254/124; 254/130; 254/131

(58) Field of Classification Search
USPC ..... 173/29, 90, 91, 126, 132, 1; 254/124, 254/129, 130, 131, 132, 30
See application file for complete search history.

(56) References Cited

U.S. PATENT DOCUMENTS

| | | | | |
|---|---|---|---|---|
| 1,916,463 | A | 7/1933 | Carrel | |
| 2,098,146 | A | 11/1937 | Hunt | |
| 2,532,533 | A | 12/1950 | Baldwin et al. | |
| 2,582,284 | A * | 1/1952 | Sarosdy | 254/132 |
| 3,712,389 | A * | 1/1973 | Smoak | 173/126 |
| 3,991,976 | A | 11/1976 | Skinner | |
| 4,226,402 | A * | 10/1980 | Muth | 254/30 |
| 4,726,565 | A | 2/1988 | Keller | |
| 4,738,433 | A | 4/1988 | Hoff | |
| 4,792,120 | A | 12/1988 | Egaas | |
| 5,009,394 | A | 4/1991 | Marshall | |
| 5,022,632 | A | 6/1991 | Beideck | |
| 5,042,591 | A | 8/1991 | Hull | |
| 5,224,687 | A * | 7/1993 | Geckler et al. | 254/30 |
| 5,368,277 | A | 11/1994 | Moss | |
| 5,681,030 | A | 10/1997 | Nall | |
| 5,713,559 | A | 2/1998 | McClarin et al. | |
| 5,794,918 | A | 8/1998 | Price | |
| 6,352,242 | B1 * | 3/2002 | Medearis | 254/30 |
| 6,364,031 | B1 | 4/2002 | Amicangelo | |
| 6,578,826 | B2 * | 6/2003 | Pilcher | 256/19 |
| 7,040,602 | B1 * | 5/2006 | Williams | 254/30 |
| 7,111,690 | B2 | 9/2006 | Kleinert | |
| 7,161,115 | B2 | 1/2007 | Stecher et al. | |
| 7,185,880 | B1 | 3/2007 | McCray | |
| 7,290,754 | B2 | 11/2007 | Mensi et al. | |
| 8,230,944 | B2 * | 7/2012 | Thiem | 173/90 |
| 2007/0181320 | A1 | 8/2007 | Mason | |
| 2007/0183121 | A1 | 8/2007 | Futrell | |

OTHER PUBLICATIONS

Krieger Machine Works, T-Post Driver and Jack all-in-one unit, Jan. 29, 2011, http://www.youtube.com/watch?v=Kli3cawBhjM &feature=related.

* cited by examiner

*Primary Examiner* — Scott A. Smith
(74) *Attorney, Agent, or Firm* — Michael G. Johnston; Moore and Van Allen PLLC

(57) ABSTRACT

There is disclosed a post extractor comprised in a post-pounder, the device having a length and a crosswise extraction hole. The hole may be sized to accept an exposed portion of the post and may have an engaging edge for engaging an exposed portion of the post. Methods of using the extractor to extract a post are also disclosed.

10 Claims, 4 Drawing Sheets

FIG. 1
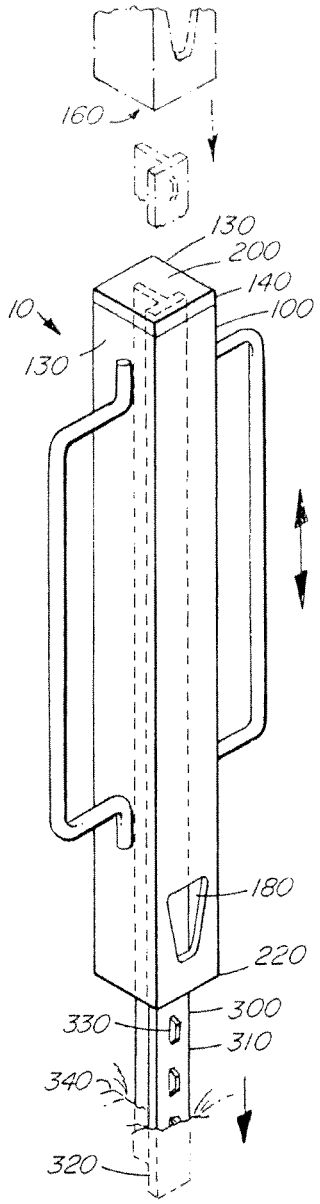
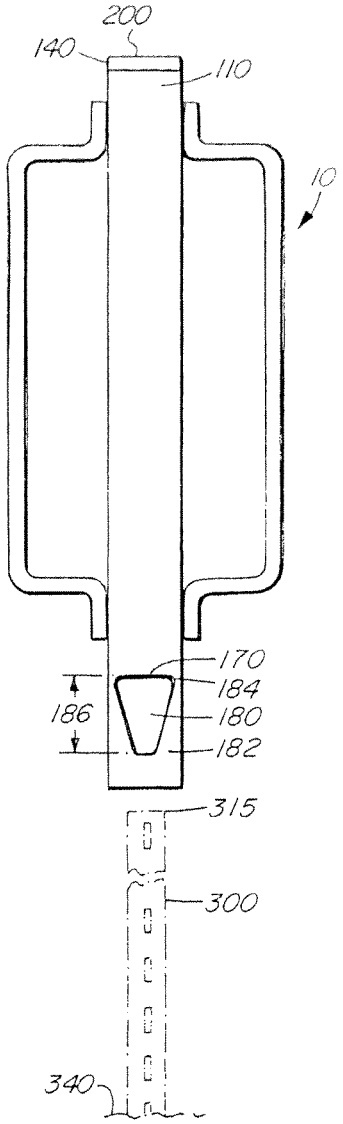
FIG. 2

POST EXTRACTOR

BACKGROUND

The subject matter disclosed generally relates to a method and device for extracting a post from a substrate.

A variety of positioning and extracting tools for posts and the like are known in the literature:

U.S. Pat. No. 6,364,031 issued on Apr. 2, 2002 to Amicangelo discloses a device for implanting rods in a substrate and for extracting rods from a substrate.

U.S. Pat. No. 5,042,591 issued on Aug. 27, 1991 to Hull discloses a device for restraining and non-rotatively driving and extracting fence posts, the device comprising a number of separate components.

U.S. Pat. No. 5,681,030 issued on Oct. 28, 1997 to Hull discloses a device for pulling fence posts. The device comprises a built in fulcrum, downward force on one end of the device being translated into an upward pulling force at its other end, to lift the post out of the substrate.

U.S. Pat. No. 5,368,277 issued on Nov. 29, 1994 to Moss discloses a device for removing T-shaped metal fence posts. The device relies on leveraged pulling of the post upwards out of the substrate and comprises several separate components.

SUMMARY

In a first embodiment there is disclosed a post-pounder comprising a post extractor, the post-pounder having a pounder length and a crosswise extraction hole, the extraction hole sized to accept an exposed portion of the post and having an engaging edge for engaging the exposed portion of the post.

In an alternative embodiment the post-pounder has first and second walls, the first and second walls defining therebetween a bore, the first wall comprising the extraction hole, and the second wall comprising an opening opposed to the extraction hole, the extraction hole and the opening being sized to accept insertion of a post.

In an alternative embodiment the post-pounder has a pounder length and wherein the opening has a opening length and the extraction hole has an extraction hole length, each of the opening length and the extraction hole length being substantially parallel to the pounder length and the opening length is longer than the extraction hole length.

In alternative embodiments the opposed extraction hole and opening are differentially sized so that the angle defined between the pounder and a post extending through the extraction hole is moveable between first and second values.

In alternative embodiments the first value is at least about 80 degrees and the second value is at least about 10 degrees and in further alternative embodiments the first value is about 65 degrees and the second value is about 25 degrees.

In alternative embodiments the post-pounder comprises handles and the bore terminates in a post pounding end.

In alternative embodiments the engaging edge is a straight edge.

In alternative embodiments the extraction hole has two ends and one end is substantially longer than the other the end.

In alternative embodiments the extraction hole is substantially triangular.

In alternative embodiments the engaging edge is useable to pry the post out of a substrate when the pounder is used as a lever. In alternative embodiments there is disclosed a method for extracting a planted post, the method comprising the steps of: providing a post-pounder having an end and an engaging edge; leaning the pounder against an exposed portion of the post so that the engaging edge engages the post, and so that an end of the pounder simultaneously rests on a substrate; repeatedly laterally displacing the post to thereby incrementally extract the post from the substrate.

In alternative embodiments the post comprises a plurality of projections and the engaging edge comprises engaging the projections.

In alternative embodiments the engaging is compressive.

In alternative embodiments the method comprises repeatedly compressing the extractor between the post and the substrate.

In alternative embodiments there is disclosed a post-extractor for extracting a post embedded in a substrate, the post-extractor characterised in comprising a post-pounding bore, an extraction edge and an extraction hole for accepting insertion of the post across the bore, and wherein the post-extractor and the inserted post are able to define therebetween a variable angle.

In alternative embodiments the extractor comprises first and second walls, the first and second walls defining therebetween the bore, the first wall comprising the extraction hole, and the second wall comprising an opposed opening, the extraction hole and the opening being sized to a post.

In alternative embodiments the opening has an opening length and the extraction hole has an extraction hole length, each length being substantially parallel to the pounder length and wherein the opening length is substantially longer than the extraction hole length.

In alternative embodiments the opposed extraction hole and opening are differentially sized so that the angle defined between the pounder and a post extending through the extraction hole is moveable between first and second values.

In alternative embodiments the first value is at least about 80 degrees and the second value is at least about 10 degrees, or the first value is at least about 65 degrees and the second value is at least about 25 degrees.

In alternative embodiments the post-pounder comprises handles and the bore terminates in a post pounding end.

In alternative embodiments, the extracting is achieved by compressing the post-extractor between the post and the substrate.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims.

Accordingly, the drawings and the description are to be regarded as illustrative in nature, and not as restrictive, and the full scope of the subject matter is set forth in the claims.

BRIEF DESCRIPTION OF THE DRAWINGS

FIG. 1 is a perspective view of a combined post-pounder and post-extractor according to a first embodiment, positioned for pounding a post.

FIG. 2 is a front view of the first embodiment positioned above a post.

DETAILED DESCRIPTION OF THE PREFERRED EMBODIMENTS

Figure 3:
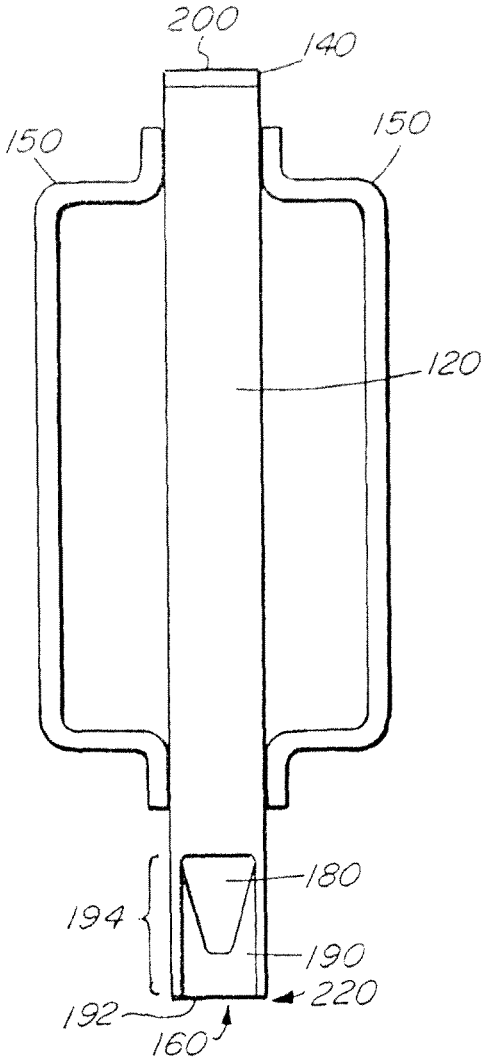
FIG. 3 is a rear view of the first embodiment according to FIG. 2.
Figure 4:
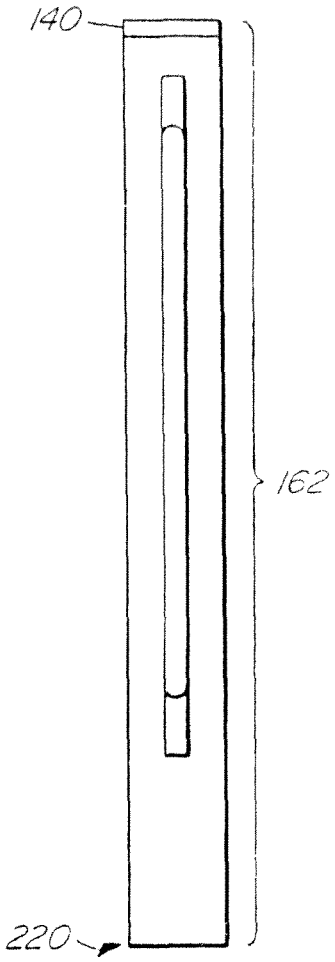
FIG. 4 is a side view of FIG. 3.

In this disclosure, the word "comprising" is used in a non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

In this disclosure the recitation of numerical ranges by endpoints includes all numbers subsumed within that range including all whole numbers, all integers and all fractional intermediates (e.g., 1 to 5 includes 1, 1.5, 2, 2.75, 3, 3.80, 4, and 5 etc.).

In this disclosure the singular forms of "an", and "the" include plural referents unless the content clearly dictates otherwise. Thus, for example, reference to a composition containing "a compound" includes a mixture of two or more compounds.

In this disclosure the term "or" is generally employed in its sense including "and/or" unless the content clearly dictates otherwise.

In this disclosure the term "unitary" indicates that a device or item does not comprise moving parts. A post-pounder or post-extractor as disclosed herein may be of unitary construction, having no moving parts or having no moving parts that are necessary for its functions of pounding and/or extracting posts.

In this disclosure, unless otherwise indicated, all numbers expressing quantities or ingredients, measurement of properties and so forth used in the specification and claims are to be understood as being modified in all instances by the term "about". Accordingly, unless indicated to the contrary or necessary in light of the context, the numerical parameters set forth in the disclosure are approximations that can vary depending upon the desired properties sought to be obtained by those skilled in the art utilizing the teachings of the present disclosure and in light of the inaccuracies of measurement and quantification. Without limiting the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, their numerical values set forth in the specific examples are understood broadly only to the extent that this is consistent with the validity of the disclosure and the distinction of the subject matter disclosed and claimed from the prior art. A first embodiment of the post extractor is generally described with reference to FIGS. 1 through 8.

In a first embodiment there is disclosed a post-extractor generally designated at 10 which may be comprised in or combined with a post-pounder. In the illustrated embodiment the post-extractor is of unitary construction and comprises no moving parts. The general structure of the post-extractor 10 is explained with particular reference to FIGS. 1, 2, 3, 4 and 8, and the use of the device is further described with particular reference to FIGS. 5A, 5B, 6 and 7. It will be understood that references herein to the post-pounder, post-extractor, pounder/extractor, post-puller and the like, all refer to the device of which a general embodiment is disclosed and is illustrated in the drawings and are interchangeable.

The post-extractor 10 is adapted for extracting a post 300 from a substrate 340 in which a portion 320 of the post is embedded, leaving a protruding exposed portion 310 of the post which is accessible. The post-extractor may have a length 162 and may have a crosswise extraction hole 180 sized to accept an exposed portion of a post 300 and having an engaging edge 170 for engaging the exposed portion 310 of the post 300. In embodiments the post 300 may be a T-post and may be a studded T-post and in embodiments the post-extractor 10 may be a rigid or substantially rigid tube.

As will be seen from FIGS. 1 through 4 and FIG. 8, in an embodiment the post-extractor comprises a tube defined by a structural surface which may be substantially square or rectangular in cross section, but may also have any other suitable cross-sectional shapes. In embodiments the post-extractor may be made of metal, which may be steel or iron, or may be made from any other suitable materials, all of which will be readily understood by those skilled in the art.

In embodiments, the body of the post-extractor 10 may comprise a plurality of walls. In the illustrated embodiment wherein the tube is substantially square in cross section, the structural surface comprises a first or front wall 110 and opposed second or back wall 120, as well as side walls 130, which extend between the first or front and second or back walls. It will be seen that first and second walls 110, 120 define therebetween a bore 160 which is generally sized to accept insertion of a post 300. First wall 110 may define or comprise an extraction hole 180, and the second wall 120 may comprise an opening 190 that may be generally opposed to the extraction hole 180. The extraction hole 180 and the opening are 190 sized to accept insertion of an exposed portion 310 of a post 300 across the bore 160. The post-extractor has a length 162 and the opening 190 has an opening length 194 and the extraction hole 180 has an extraction hole length 186. Each of the opening length 194 and the extraction hole length 186 are substantially parallel to the pounder length 162 and the opening length 194 is longer than extraction hole length 186. The extraction hole 180 comprises an extraction edge for engaging a surface of a post to be extracted, it will be understood that such an extraction edge may be adapted by the use of non-slip surfaces, hardening, the addition of strengthening or stiffening materials, or by a variety of other methods that will be readily understood and implemented by those skilled in the art so as to improve the durability and effectiveness of the extractor.

A method for use of the extractor as a post-pounder is shown particularly in FIG. 1 and it will be seen that the device is used in a conventional manner, wherein the exposed portion 310 of a post 300 is longitudinally inserted into the bore 160 of the post-pounder/post-extractor and by repeatedly raising the device 10 and lowering it to impact the upper end 315 of the post, the device may be used to incrementally drive the post 300 longitudinally into the substrate 340. End 200 of the post-extractor may be thickened, strengthened, weighted or otherwise adapted to constitute a pounding surface and to suit its function of repeatedly impacting the end 315 of the post 300.

Figure 5A:
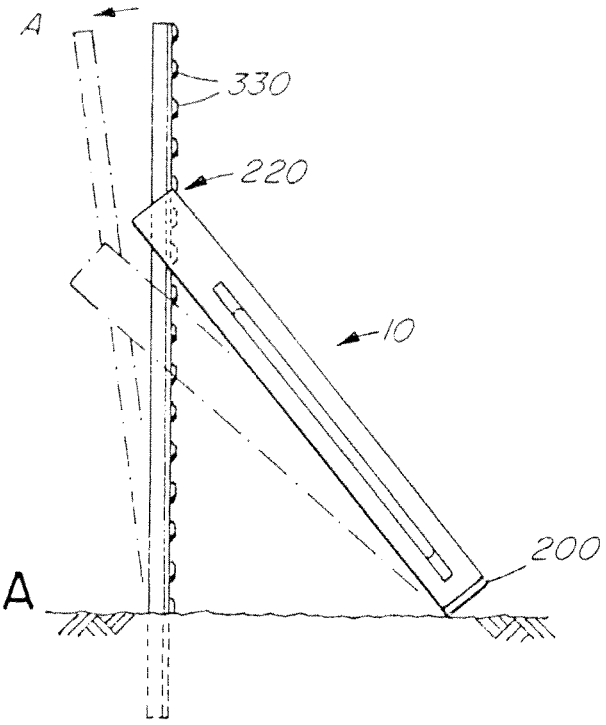
FIG. 5A is a first step in extracting a post using the post-extractor according to FIG. 1.
Figure 6:
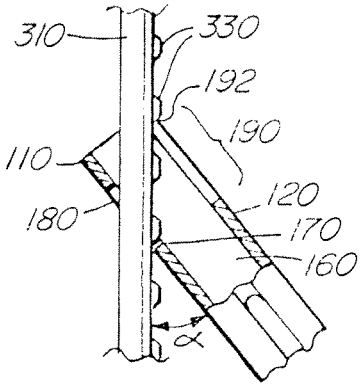
FIG. 6 is a cross section of the engagement between a post and post-extractor.
Figure 5B:
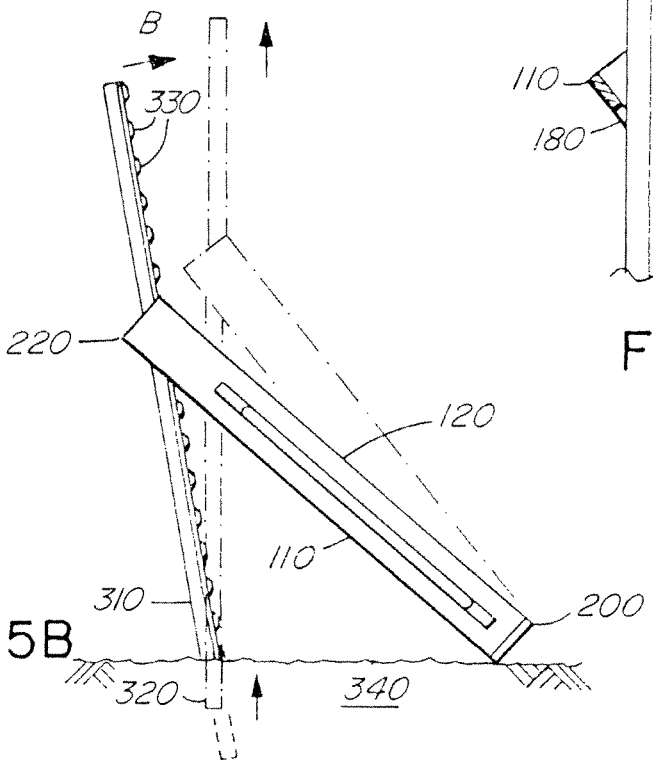
FIG. 5B is a second step in extracting a post using the post-extractor according to FIG. 5A.

In embodiments the opposed extraction hole 180 and opening 190 are differentially sized so that, as will be seen from FIGS. 5A, 5B and 6 the angle defined between the pounder and a post 300 extending through the extraction hole 180 is adjustable between first and second values. For ease of reference the angle between the first and second values of the angle of intersection between the post and extractor is generally designated as $\acute{\alpha}$. In embodiments the first value may be about 80 degrees and the second value may be about 10 degrees. In alternative embodiments the first value may be about 65 degrees and the second value may be about 25 degrees, or in further alternative embodiments the first value may be about 75, 70, 65, 60, 55, 50, 45, 40, 35 or less degrees and the second value may be about 10, 15, 20, 25, 30, 35, 40, 45 or more degrees. Without limitation angle $\acute{\alpha}$ defined by said first and second value may be up to or less than about 70, 60, 50, 40, 30 or less degrees. It will be seen that in operation the angle $\acute{\alpha}$ will generally be an acute angle selected from amongst the foregoing values and that a user will select an angle wherein the post-extractor does not slide along the surface of substrate 340 when the post is moved so as to compress the post-extractor between the post and substrate. It will also be apparent that in some circumstances it may be necessary or desirable to provide a solid support, such as a piece of wood or metal, upon which the lower resting end 200 of the post-extractor (as seen for example in FIGS. 5A and 5B) may be compressed, so that this end is not merely driven into the substrate and is not unintentionally displaced laterally when compressive force is applied to the post-extractor.

Figure 8:
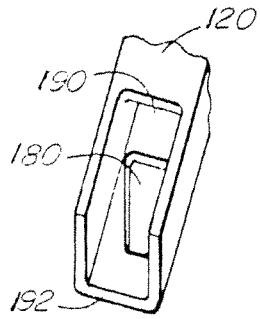
FIG. 8 shows a perspective view of detail of the first embodiment

It will be understood that the opening 190 in the second wall may be of any suitable shape, and may be defined over all its perimeter or only over a portion of its perimeter, which may extend into the side walls 130 joining first and second walls 110 and 120 and in embodiments as illustrated in FIG. 3 and as particularly shown in FIG. 8, the opening 190 may simply be an open ended space formed by truncation of second wall 120. It will be apparent that in alternative embodiments opening 190 may be fully or partly enclosed by portions of one or more of second wall 120 and side walls 130.

Figure 7:
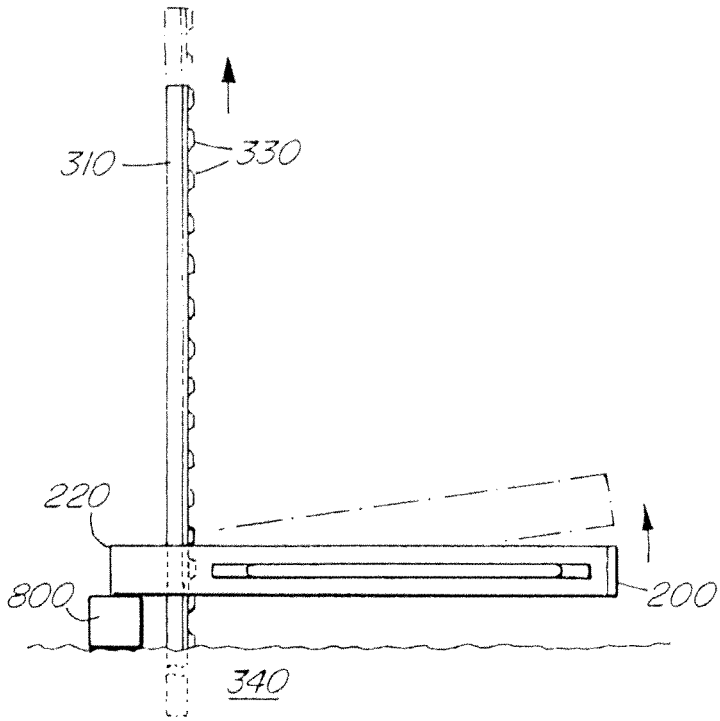
FIG. 7. shows the use of a post-extractor according to FIG. 1 to pry a post loose from a substrate.

In embodiments, as further illustrated particularly in FIGS. 1 though 4, the post-extractor/post-pounder 10 may comprise handles 150 and the bore 160 may be closed at a first end 200 by a pounding or end plate 140. The second end 220 of the post-pounder/post-extractor may be open. In embodiments, the engaging edge 170 may be a straight edge. In embodiments the extraction hole 180 may have two ends and one of the ends 184 may be substantially wider than the other end 182 and the wider end 184 may comprise or be associated with the engaging edge 170. In embodiments and as will be seen the extraction hole 180 may be substantially triangular and may optionally be sized to suit particular dimensions of a post to be extracted. As illustrated in FIG. 7, in embodiments the engaging edge 170 is useable to pry the post 300 out of a substrate 340 when the post-pounder/post-extractor 10 is used as a lever. Where the post-extractor 10 is used as a lever to pry a post 300 out of the substrate 340, then end 200 of the post-extractor may be raised while opposed end 220 rests against substrate 340 or a support or other suitable fulcrum generally designated 800. With exposed post section 310 extending through extraction hole 180 and engaging edge 170 engaging a lug 330 (alternately referred to as a projection, ridge, or equivalent structure) of exposed post section 310, upwardly displacing end 200 of the post-extractor 10 will serve to pull post 300 upwards. It will be apparent that it may be necessary or desirable to repeat this operation by alternately engaging a lug 330, pulling up on end 200, and then disengaging the lug, lowering end 200 and then reengaging another lug. The procedure can be repeated until a desired degree of displacement of the post 300 has been achieved.

It will be seen that where the opening 190 is suitably positioned near an end of the post-extractor 10, then an end 192 of the opening may be unenclosed and the opening 190 may be formed by a recess, cutout, or other discontinuity or shaping of the second or back wall 120. This may be best seen in FIG. 3, which is viewed from the second or rear face 120, and wherein the extraction hole 180 is seen through the opening 190, and in FIG. 8 which shows a perspective view.

A method for extracting a planted post generally designated 300 is described with particular reference to FIGS. 5A, 5B and 6. The post may comprise an exposed portion 310 and a buried portion 320 embedded in a substrate 340 and may comprise raised projections or studs 330. The method may comprise the steps of: providing a post-pounder generally designated at 10 which may have a first end 200, may have a second end 220 and may comprise an engaging edge 170. The method comprises leaning the post pounder 10, against an exposed portion 310 of the post 300 so that engaging edge 170 engages the post, and so that the pounding end 200 of the pounder 10 simultaneously rests on a substrate 340. Additionally, the method comprises repeatedly laterally displacing the post 300 generally in line with the length of the post-extractor/post-pounder to thereby incrementally extract the post 300 from the substrate 340. In embodiments the post may comprise a plurality of projections or lugs 330 which are alternatively referred to herein as lugs, nobs, studs or the like, and the engaging comprises engaging any of said projections 330. In embodiments the engaging between engaging edge 170 and post 300 or lug 330 is compressive.

In embodiments the method may comprise repeatedly compressing the pounder/extractor between the post 300 and the substrate 340. As will be seen, with pounder/extractor 10 leaning into position and post 300 inserted through extraction hole 180 and opening 190, upward displacement of the post in a first direction A (as shown in FIG. 5A), allows the extraction edge 170 to slide down the exposed portion 310 of post 300 to engage a lug 330. Then when the post is displaced in the opposite direction B (as shown in FIG. 5B) then the compressive force between a lug 330 and engaging edge 170 will force post 300 a distance up and out of the substrate 340. The post 300 may have to be repeatedly and alternately displaced in directions A and B to free it from the substrate 340 or to loosen it to allow it to be directly pulled free of the substrate 340.

FIG. 6 shows detail of the insertion of exposed portion 310 of the post through extraction hole 180 and through opening 190, the post-extractor 10 being oriented so that front wall 110 comprising extraction opening 180 is nearer to the substrate 340 and so that opening 190 is further from the substrate. It will be seen that the relative size and positioning of extraction hole 180 and opening 190 allows the angle $\acute{\alpha}$ to be varied as the post is moved between the extremes of directions of motion A and B.

In an alternative embodiment there is disclosed a post-extractor 10 for extracting a post 300 embedded in a substrate 340, said post-extractor 10 characterised in comprising an extraction edge 170 and an extraction hole 180 for accepting the exposed portion 310 of post 300 and wherein the post-extractor 10 and the inserted post 300 are able to define therebetween a variable angle $\alpha$. The post-extractor 10 may be comprised in or combined with a post pounder having a bore 160, and wherein insertion of the post 300 is crosswise relative to the length of the post-extractor 10 and its longitudinal bore 160. The post-pounder/post-extractor may comprise first wall 110 and second wall 120 and the first and second walls may at least partly define the bore. The first wall 110 may comprise or define the extraction hole 180, and the second wall 120 may comprise an opposed opening 190, the hole and opening being sized to accept a post 300. In embodiments the opening 190 may have a opening length 194 and the extraction hole 180 may have an extraction hole length 186, each said length being substantially parallel to the length of the post-pounder/extractor 10, which extends between first and second ends, 200 and 220. The opening length 194 may be substantially longer than the extraction hole length 186.

In embodiments the opposed extraction hole 180 and opening 190 are differentially sized so that the angle defined between the post-pounder 10 and a post 300 extending through the extraction hole is moveable between first and second values. In embodiments the first value may be about 80 degrees and the second value may be about 10 degrees. In alternative embodiments the first value may be about 65 degrees and the second value may be about 25 degrees.

In embodiments post-pounder/extractor 10 comprises handles 150 and the bore 160 terminates in a first end 200 which may be a post pounding end and may accordingly be thickened or strengthened in ways readily apparent to those skilled in the art. The engaging edge 170 may be a straight edge. In embodiments the extraction hole 180 may have two ends and one end 184 of the hole may substantially wider than the other end 182 of the hole. In embodiments the extraction hole 180 may be substantially triangular. In embodiments the engaging edge 170 may be useable to pry the post 300 out of a substrate 340 by using the post-pounder 10 as a lever. In embodiments the extracting of the post 300 is achieved by compressing the post-pounder/post-extractor 10 between the exposed portion 310 of the post 300 and the substrate 340.

It will be noted that the embodiments disclosed do not require a user to use the post-extractor as a lever, although as noted above, a user may elect to do so, and the extraction process may be driven by repeated lateral displacements of a post to be removed. Those skilled in the art will readily understand how the operation of the method and the use of the post-extractors of embodiments may be adapted to suit a variety of environments and operational requirements. For example, where the substrate is soft then a strong supporting structure may be provided to withstand the compression between the extractor and the substrate, or where the substrate surface is slippery then provision may be made to reduce slippage and preserve the compressive force that the extractor exerts on a post.

The embodiments and examples presented herein are illustrative of the general nature of the subject matter claimed and are not limiting. It will be understood by those skilled in the art how these embodiments can be readily modified and/or adapted for various applications and in various ways without departing from the spirit and scope of the subject matter disclosed claimed. The claims hereof are to be understood to include without limitation all alternative embodiments and equivalents of the subject matter hereof. Phrases, words and terms employed herein are illustrative and are not limiting. Where permissible by law, all references cited herein are incorporated by reference in their entirety. It will be appreciated that any aspects of the different embodiments disclosed herein may be combined in a range of possible alternative embodiments, and alternative combinations of features, all of which varied combinations of features are to be understood to form a part of the subject matter claimed. Particular embodiments may alternatively comprise or consist of or exclude any one or more of the elements disclosed.

What is claimed is:

1. A post-extractor for removing a post from a substrate, the post-extractor comprising a body member having a longitudinal axis, the body member including a first wall, and a second wall spaced from the first wall, the first wall and the second wall defining a bore therebetween, the first wall having an extraction hole opening into the bore and adapted to receive an exposed portion of the post and an engaging edge at least partially defining the extraction hole for engaging said exposed portion of the post, and the second wall having an opening into the bore opposite the extraction hole and adapted to receive the exposed portion of the post, wherein each of the extraction hole and the opening have a length along the longitudinal axis of the body member, and wherein the length of the opening is longer than the length of the extraction hole so that the body member is adapted to form a variable angle with the exposed portion of the post passing through the extraction hole and the opening while the edge of the first wall is engaging the post.

2. The post-extractor according to claim 1 wherein said variable angle is between about 65 degrees and about 25 degrees.

3. The post-extractor according to claim 2 wherein said post-pounder comprises handles mounted on the body member, and wherein said bore terminates in a post pounding end.

4. The post-extractor according to claim 3 wherein said engaging edge is substantially straight.

5. The post-extractor according to claim 4 wherein said extraction hole has two ends spaced along the longitudinal axis of the body member, and wherein one said end is substantially longer than the other said end.

6. The post-extractor according to claim 1 wherein said post-extractor is of unitary construction.

7. A post-extractor for extracting a post embedded in a substrate, said post-extractor comprising a body member having a longitudinal axis, the body member including a first wall, and a second wall spaced from the first wall, the first wall and the second wall defining a bore therebetween, the first wall having an extraction hole opening into the bore and adapted to receive an exposed portion of the post, and an extracting edge at least partially defining the extraction hole for engaging said exposed portion of the post, and the second wall having an opening into the bore opposite the extraction hole and adapted to receive the exposed portion of the post, wherein each of the extraction hole and the opening have a length along the longitudinal axis of the body member, and wherein the length of the opening is longer than the length of the extraction hole so that the body member is adapted to form a variable angle with the exposed portion of the post passing through the extraction hole and the opening while the edge of the first wall is engaging the post.

8. The post-extractor according to claim 7 wherein said variable angle is between about 65 degrees and about 25 degrees.

9. The post-extractor according to claim 7 wherein said post-extractor comprises handles mounted on the body member, and wherein said bore terminates in a post pounding end.

10. The post-extractor according to claim 7 wherein said post extractor is of unitary construction.

* * * * *

UNITED STATES PATENT AND TRADEMARK OFFICE

CERTIFICATE OF CORRECTION

PATENT NO. : 8,701,791 B2
APPLICATION NO. : 12/967659
DATED : April 22, 2014
INVENTOR(S) : Justin Page It is certified that error appears in the above-identified patent and that said Letters Patent is hereby corrected as shown below:

IN THE CLAIMS:

In column 8, claim 1, please change line 8 to:

"the post, and the second wall having an opening opening into"

In column 8, claim 7, please change line 43 to:

"the post, and the second wall having an opening opening into"

Signed and Sealed this
Twenty-ninth Day of July, 2014

Michelle K. Lee

Michelle K. Lee
*Deputy Director of the United States Patent and Trademark Office*